US005218998A

United States Patent [19]

Bakken et al.

[11] Patent Number: 5,218,998

[45] Date of Patent: Jun. 15, 1993

[54] LINEARLY ADJUSTABLE

[76] Inventors: Gary M. Bakken, 340 E. Canyon View Dr., Tucson, Ariz. 85704; Phillip E. Branham, 6570 N. First Ave., Tucson, Ariz. 85718; William R. Acorn, 6260 Placita del Nido, Tucson, Ariz. 85715

[21] Appl. No.: 861,514

[22] Filed: Apr. 1, 1992

[51] Int. Cl.[5] ..... F16K 3/32; F24F 13/16

[52] U.S. Cl. ..... 137/625.28; 137/625.3; 137/625.33; 137/625.32; 454/298; 454/322; 454/324

[58] Field of Search ..... 137/625.28, 625.3, 625.33, 137/625.32; 454/298, 324, 322

[56] References Cited

U.S. PATENT DOCUMENTS

| | | | |
|---|---|---|---|
| 2,470,488 | 5/1949 | Honerkamp et al. | 454/324 X |
| 4,473,210 | 9/1984 | Brighton | 137/625.3 X |
| 4,681,613 | 7/1987 | Porter | 251/205 X |
| 5,014,608 | 5/1991 | Benson et al. . | |

FOREIGN PATENT DOCUMENTS

| | | | |
|---|---|---|---|
| 1023845 | 1/1953 | France | 137/625.3 |

*Primary Examiner*—Arnold Rosenthal
*Attorney, Agent, or Firm*—J. Michael McClanahan

[57] ABSTRACT

A linearly adjustable fluid damper of the sliding plate adjustable orifice type damper system having a fixed flat plate with a plurality of specifically arranged trapezoidal shaped apertures therethrough, and a slideably adjustable flat plate also having a plurality of specifically arranged trapezoidal shaped apertures therethrough. The sliding plate is juxtaposed the fixed plate such that apertures of the sliding plate overlap apertures of the fixed plate, and aperture orientation of the sliding plate is reversed that of the orientation of the apertures on the fixed plate. The area of the resultant hexagonal composite orifice through both plates varies non-linearly from full open position to full closed position throughout movement of the sliding plate. The result is that fluid flow from zero fluid flow to maximum fluid flow through the resultant orifice is a straight line relationship with linear displacement of the sliding plate. Dampers comprising this configuration may thus be preset to predetermine openings in fluid flow operations to achieve desired results. Alternate embodiments of the invention include use of semi-cylindrical plates and cone shaped plates.

22 Claims, 6 Drawing Sheets

LINEARLY ADJUSTABLE

BACKGROUND OF THE INVENTION

1. Field of the Invention

The field of the invention is adjustable orifice fluid dampers utilized in air and liquid handling systems such as those utilized in manufacturing and assembly clean rooms, ducts, pipes, air handling and fluid flow systems.

2. Description of the Related Art

Fluid flow systems rely on the accurate adjustment of the fluid medium in consideration of static and dynamic conditions. In many cases, dampers are utilized in fluid flow systems for accurate adjustment of the fluid medium.

Existing generic types of dampers in general use today which accomplish the goals of adjustment of fluid flow include multiple parallel blade type dampers wherein a number of elongated blades are placed in an arrangement such that the blades touch or overlap one another in the closed position to form a plane surface across the opening and to controllably restrict fluid flow. The blades rotate lengthwise about a shaft generally situated centrally of the blade.

In addition, multiple opposed blade dampers have a similar blade arrangement to the multiple parallel blade dampers wherein generally elongated blades are juxtaposed each other, rotating about a lengthwise centrally located shaft through the blade, the edges of the blades touching each other to effect a seal in the closed position or, when in the open position, are situated vanelike parallel to each other. The blades are linked together to move simultaneously, each blade, however, rotating in a direction opposite to that of the two adjacent blades.

Another system, namely, sliding single blade dampers, blocks all or a portion of the fluid passageway, the single blade slideable in and out of the passageway.

Another type of damper consists of a single blade, known as a butterfly, mounted on a shaft in the middle of the blade. As the shaft is rotated, the blade closes off the opening in its entirely or in part or reaches a point where the blade is parallel to the fluid stream, effectively opening the passageway to flow.

Lastly, and certainly not conclusively, are sliding orifice dampers generally consisting of two planar surfaces, each surface provided with a plurality of apertures for the passage of air or liquid. The movement of one plate relative to the other causes a variation in the effective area of the superimposed apertures, such that the effective area, or free area, available for fluid flow through the plates varies from zero (fully closed) to a maximum available defined by shape, size, and spacing of the apertures, when the two planar surfaces are in alignment. Current configurations of apertures in sliding plate dampers include circles, squares, rectangles, and elongated slots with and without circular ends. The pattern of the apertures usually takes on uniformly spaced columns and rows. The type of orifice and pattern of the apertures on each plate are identical, such that when the two plates are aligned, the resultant pattern is as if there were only one plate since the apertures of one plate match the apertures of the other plate.

The problem with the multiple parallel blade dampers, multiple opposed blade dampers, single sliding blade dampers, butterfly dampers, sliding orifice dampers, and all other damper systems known to the inventors, is that the relationship of fluid flow (from zero to maximum) versus damper position (from fully closed to fully open) is characteristically non-linear.

One widely used application of dampers to regulate fluid flow is in clean rooms wherein products are manufactured or assembled that require particle contamination be kept to a minimum. An example of this is clean room areas utilized in semiconductor manufacture. In clean rooms, airborne particulates are a significant source of contamination such that the product may well be rendered non-usable if contaminated. In clean room technology, filtered air enters the clean room via the ceiling from a plurality of equally spaced filtered openings (which may virtually encompass the whole ceiling) and may exit the clean room through the floor which is a series of grates or perforated panels. The air is then recirculated through the filters. It is important that the flow of air through the clean room be laminar from the ceiling to the floor so that contaminants in the air, or contaminants arising from the equipment in the room or from personnel in the room, fall straight to the floor and through the grille, or perforated panel and then captured in the filter system recirculating the air. Turbulence in the air, however, will cause the particulate matter to move horizontally or perhaps vertically upward and then downward thereby enhancing the possibility that airborne particles may contaminate the work product.

In many clean room applications, control of the air for laminar flow is attempted in part by an under-the-floor damper system which resides generally two or more inches below the floor grate or panel. Clean room damper systems are generally divided into cells, ranging in various rectangular and square configurations with sides of one to four feet. Many times the cell sizes are dictated by the mechanical constraints of the clean room, however, having a plurality of cells with contained damper systems does work to the advantage of clean room design. In clean rooms are typically situated work benches, work areas, and machinery. The work benches and machinery rest on the floor grate and as a consequence, it may not be possible for air to pass through the floor grate immediately underneath the pieces of equipment. Consequently, dampers in cells located under the floored equipment are usually closed to air passage.

In fact, clean room technology has advanced to the point where, when all the parameters are known, i.e., the size and placement of the standing equipment is known, air flow in the areas not covered by standing equipment can be calculated and determined for maintaining laminar flow of the air in the room. As earlier mentioned, air usually enters the clean room from the ceiling and substantially uniformly over the area of the ceiling. To maintain laminar flow or to reduce turbulence to a minimum, the flow through different areas of the floor will naturally be different.

The problem in the past has been that while the air flow through different areas of the floor to maintain laminar flow or minimum turbulence can be calculated, yet the damper technology heretofore is such that each damper in each cell passing air requires that the damper be experimentally adjusted to achieve the desired air flow. This results from the earlier stated characteristic of the existing damper technology in that the relationship between change in damper opening and fluid flow is non-linear. Consequently, the time that it takes to adjust clean rooms for laminar air flow can be quite prolonged.

Thus, it is readily apparent that it would be advantageous if the damper system utilized in fluid flow applications could be preset to calculated flow before or during constructing of the fluid handling system utilizing the damper systems.

Just as apparent, it would also be very advantageous if a damper system were available which exhibited characteristics of linearity between fluid flow and relative mechanical position of the elements which comprise the damper system.

More particularly, in a sliding orifice damper system, great advantage would accrue utilizing a damper system which provides a linear relationship between adjustment position (which can be repeatedly and accurately set) and fluid flow and thus afford the user the means to accurately predict system performance with a properly controlled fluid medium.

SUMMARY OF THE INVENTION

The present invention provides a sliding plate orifice damper system consisting of a first plate with uniformly spaced apertures slideably secured to a fixed plate also having uniformly spaced apertures, the system is usable in a wide variety of fluid flow applications such as channels, outlets, inlets, ducts, pipes, plenums, cells or other fluid handling apparatus. In this discussion, each of the plates have apertures, and the coincidence of two apertures (one on the top sliding plate and one on the bottom fixed plate) results in an orifice, which also may be called a composite orifice, through which the fluid flows.

Briefly, each plate consists of flat, thin, metal or other material sheet which includes a plurality of apertures of unique shape, configuration, and orientation. More particularly, each aperture of each plate is trapezoidal in shape with the geometry of the trapezoid carefully evaluated to yield the desired linear relationship between relative position of one plate to the other and rate of fluid flow. The trapezoidal apertures on both the fixed plate and the sliding plate are the same size and arranged in like fashion during fabrication of the plates, i.e., the major base and minor base of each trapezoid is oriented similarly. However, the orientation of the fixed plate to the sliding plate is opposite to each other in the finished damper system, i.e., the two plates slide over each other such that the resultant composite orifice through both plates is hexagonal in shape. Even though each aperture in each plate is identical in size, there is no position of the sliding plate (relative to the stationary plate) where the apertures overlap, such that a truly resultant trapezoidal orifice results.

As the sliding plate moves relative to the fixed plate, the resultant composite orifice changes from an arrangement where the width (perpendicular to the direction of travel) is considerably shorter than the length (parallel to the direction of travel) when the damper is at full 100% open position, to an arrangement where the width is considerably longer than the length as the damper nears its closed position.

The result of this unique geometry of orifices and relative positioning of orifices is that the performance of the damper is such that there is a linear relationship between a change in sliding plate to fixed plate position (as measured by a percentage of travel from full open to full close) and the change in air flow through the damper (measured from zero flow to full flow). This results in a significant improvement over the existing damper technologies and prior art which exhibits nonlinear flow/position characteristics.

It is an object of the subject invention to provide a sliding plate orifice damper system which provides a linear distance relationship of the sliding plate (relative to the fixed plate position) to air flow through the system.

It is another object of the subject invention to provide a sliding plate damper system having means by which the ability to accurately, reliably, and repeatedly adjust and control the fluid flow may be assured.

Other objects of the invention will, in part, be obvious and will, in part, appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
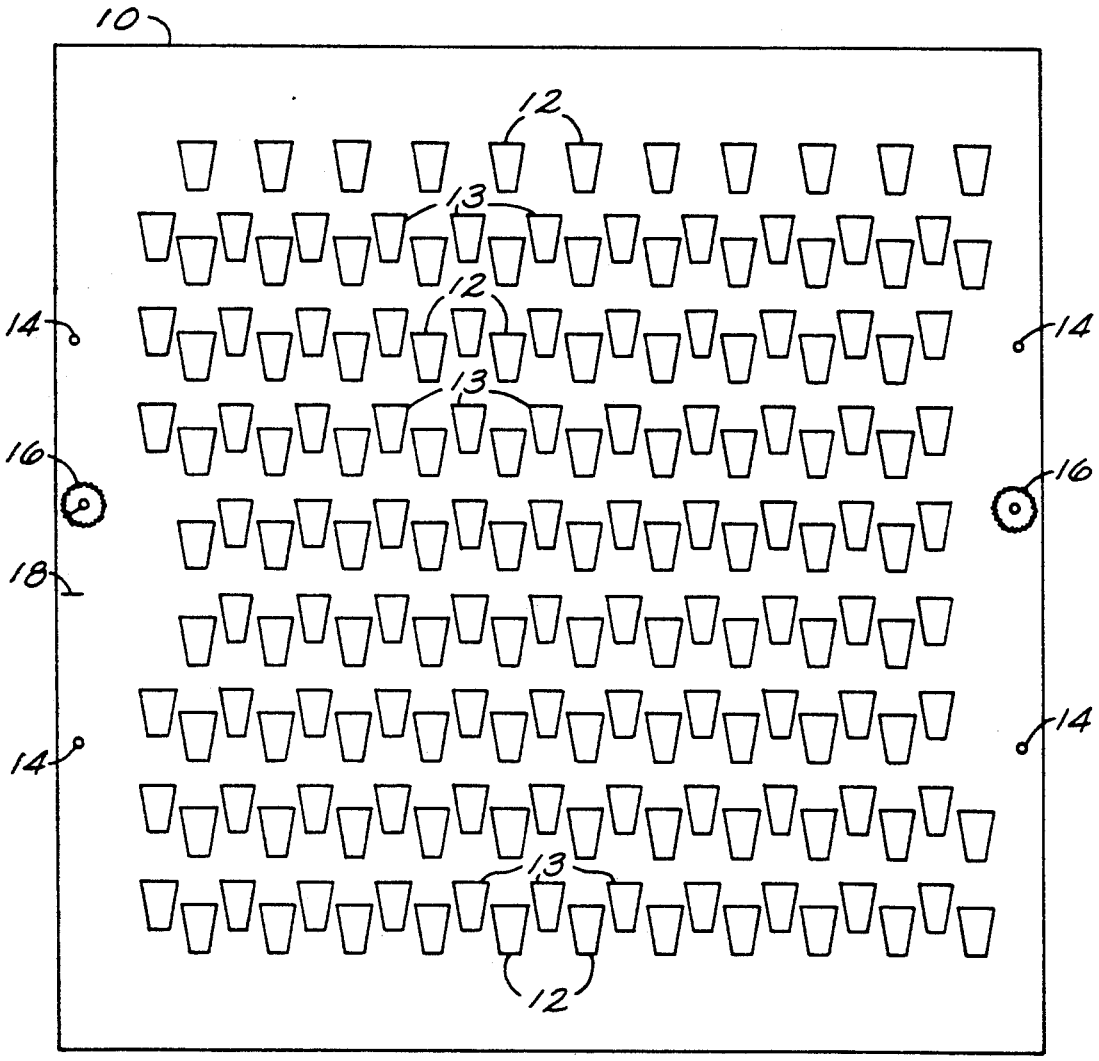
FIG. 1 is a top view of the bottom plate in the inventive sliding plate orifice damper system utilizing a unique arrangement of trapezoidal apertures.

Referring now to FIG. 1, a top plan view is shown of bottom plate 10 of the inventive sliding plate orifice damper system 1 wherein the orientation (direction) and arrangement of the trapezoidal apertures 12 and 13 is illustrated. As previously mentioned, the plate is preferably constructed of thin sheet metal, such as steel or aluminum, or a composite of materials of comparable strength and rigidity, and will usually be rectangular or square in shape, especially when utilized in an under-the-floor cell application in clean rooms.

Arranged in rows and columns are the plurality of trapezoidal apertures 12 and 13. The pattern of apertures on the stationery bottom plate is that of a series of two evenly spaced rows commencing with the top row of the first series apertures 12 which is then repeated, seven times, in the exemplar drawing. A second series of evenly spaced rows of apertures 13 are situated slightly above the first series of aperture 12 rows commencing with the second row of the first series. Commencing with the second row of first series apertures 12 and the first row of second series apertures 13, the rows are interlaced.

It is noted that the apertures 12 of first series rows and apertures 13 of second series rows are aligned with respect to each other in separate columns which also interlace, a column comprising one trapezoidal apertures 12 in each of the first series rows and a column comprising one trapezoidal apertures 13 in each of the second series rows. Naturally, the number of rows and columns (of the first and second series) can vary depending upon the size of plate and the dimensions of each trapezoidal aperture.

Although it may not be clear at this point, the pattern of trapezoidal apertures 12 and 13 shown in FIG. 1 is a very efficient arrangement of apertures in that when the top sliding plate 20 of the damper system 1 is in position atop bottom plate 10 (FIG. 2), each trapezoidal aperture of both the top and the bottom plates so interact with its opposite counterpart that no trapezoidal aperture intersects with more than one other trapezoidal aperture. In other words, at no time will a trapezoidal aperture in the top sliding plate form a resulting orifice with more than one trapezoidal aperture of the bottom plate, and vice versa. The spacing then between rows is necessary to allow appropriate blocking of the aperture (or parts of the aperture) not contributing to the composite orifice.

In the preferred embodiment using steel or aluminum plates, the trapezoidal apertures shown at bottom plate 10 were formed by the punching process utilizing dies. Of course, using other types of materials for the plate will require other manufacturing techniques to form the apertures.

Continuing, and also shown in FIG. 1 are the means by which alignment of the top sliding plate 20 (FIG. 2) upon bottom plate 10 is maintained, namely through four guide posts 14, two of which are each situated on opposite sides of bottom plate 10. Guide posts 14 are threaded upright steel pins secured to bottom plate 10, that may also be used to secure the upper plate position with use of a nut on one or more of each guide post. Located between the two guide posts 14 on each side are rotatably mounted toothed gears 16, generally centrally located on each side of bottom plate 10. Each toothed gear 16 engages a slotted rack formed in the sheet metal of top sliding plate 20 (FIG. 2) for movement of top plate 20. Toothed gear 16 is easily rotated by means of a screw driver engaging a slot formed in the central axle to which gear 16 is attached. Other gear devices may be used in other applications. In some applications, a gear system is not employed. Lastly shown in FIG. 1 is datum point 18, a reference mark against which a calibration scale inscribed on the top plate 20 is compared as it moves in close proximity. Datum point 18 permits preliminary setting of the sliding plate prior to installation or after installation and prior to use.

Figure 2:
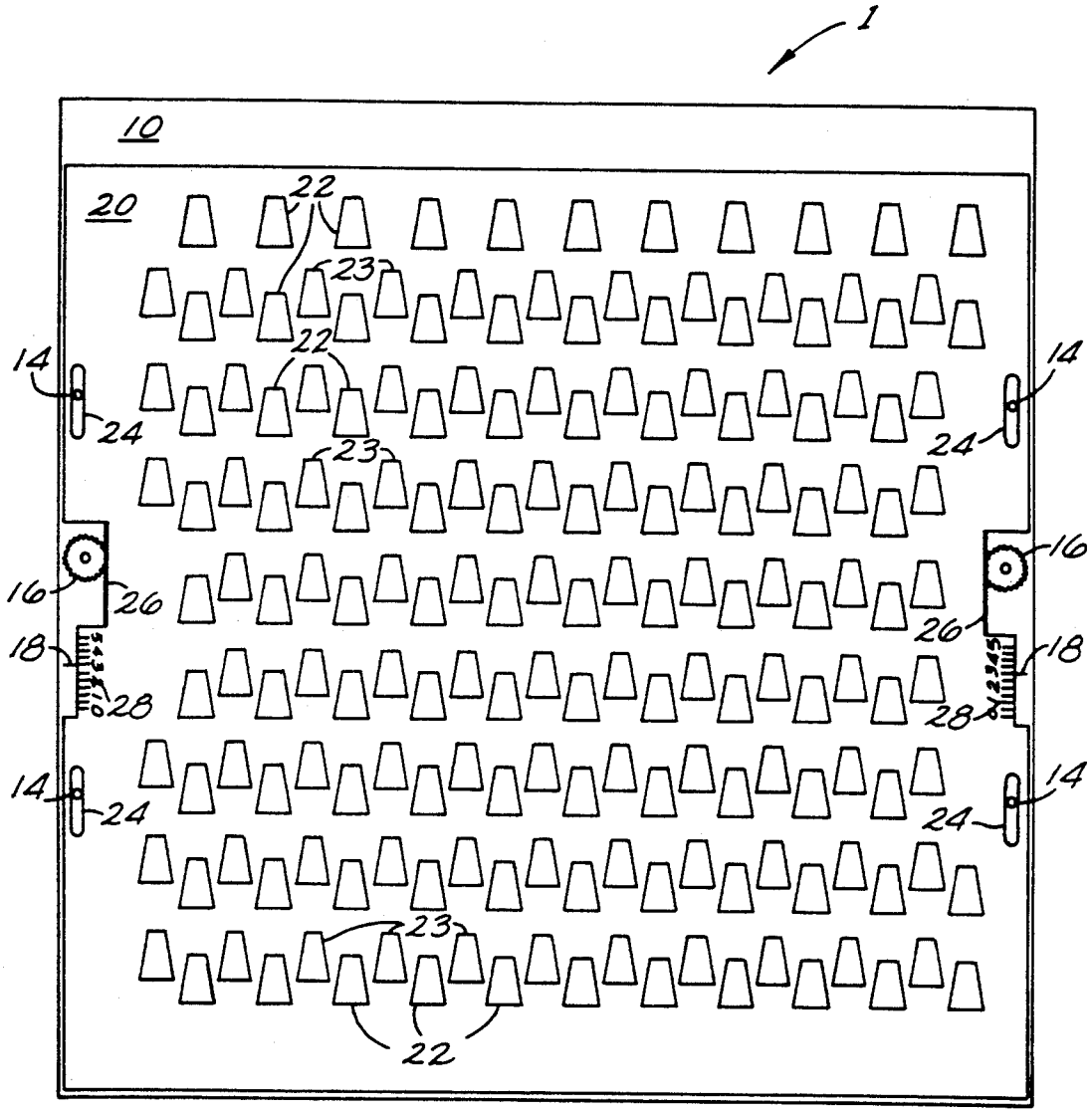
FIG. 2 is a top plan view of the subject inventive sliding plate orifice damper system showing the top plate and portions of the underlying bottom plate.

FIG. 2 is a top plan view of top sliding plate 20 situated over the fixed bottom plate 10 to form the sliding plate orifice damper system 1. For ease of viewing and to reduce possible confusion, apertures in bottom plate 10 are not shown. However, trapezoidal apertures 22 and 23 of top plate 20 are seen in the arrangement they take with an orientation that assumes the trapezoidal apertures of bottom plate 10 underneath top plate 20 have just the opposite orientation. A pictorial orientation of trapezoidal apertures of the top sliding plate compared to the bottom fixed plate is detailed in FIG. 3.

Continuing in FIG. 2, apertures 22 and 23 of top plate are arranged in the same general arrangement of first series of rows of apertures 22 and second series of rows of apertures 23 with the second series of trapezoidal apertures 23 interlaced with those of first series apertures 22 commencing with the second row of first series of apertures 22. Further constraints upon the locations of the trapezoidal apertures 22 and 23 of top sliding plate 20 is that their locations are complimentary with the locations of the trapezoidal apertures 12 and 13 of bottom plate 10 when the orientation of apertures of one place to the other is reversed.

Also shown in FIG. 2 are the mechanical means by which the two plates relate to each other. Firstly, guide slots 24, two of which are each located on opposite sides of sliding plate 20, are so arranged as to receive guide posts 14 of bottom plate 10. Obviously, guide posts 14, in riding in guide slots 24, maintain the sliding alignment of top plate 20 upon fixed bottom plate 10 so that the alignment of the apertures 22 and 23 in top plate 20 as top plate 20 is moved are consistent with apertures 12 and 13 of bottom plate 10. Further shown in FIG. 2 are the two toothed gears 16 on opposite sides which, as indicated above, engage slotted rack 26 attached to top sliding plate 20. For ease of manufacturing, when top plate 20 is constructed, slotted rack 26 is formed in outstanding tabs as part of the sheet metal wherein the tabs are then bent upward at right angles to the sheet. The slots of slotted rack 26 are formed in these tabs by punching or other appropriate method. By rotation of either or both toothed gears 16, sliding plate 20 is moved in the direction of the elongated guide slots 24 such that more or less composite orifice size is formed by the overlapping apertures.

Lastly shown in FIG. 2 is calibrated scales 28, inscribed upon the edge of top sliding plate 20 on opposite sides and located in the proximity of datum point 18 (scribed on bottom plate 10). By use of calibrated scale 28 in conjunction with datum point 18, the relative position of top sliding plate 20 upon bottom fixed plate 10 may be easily seen.

Figure 3:
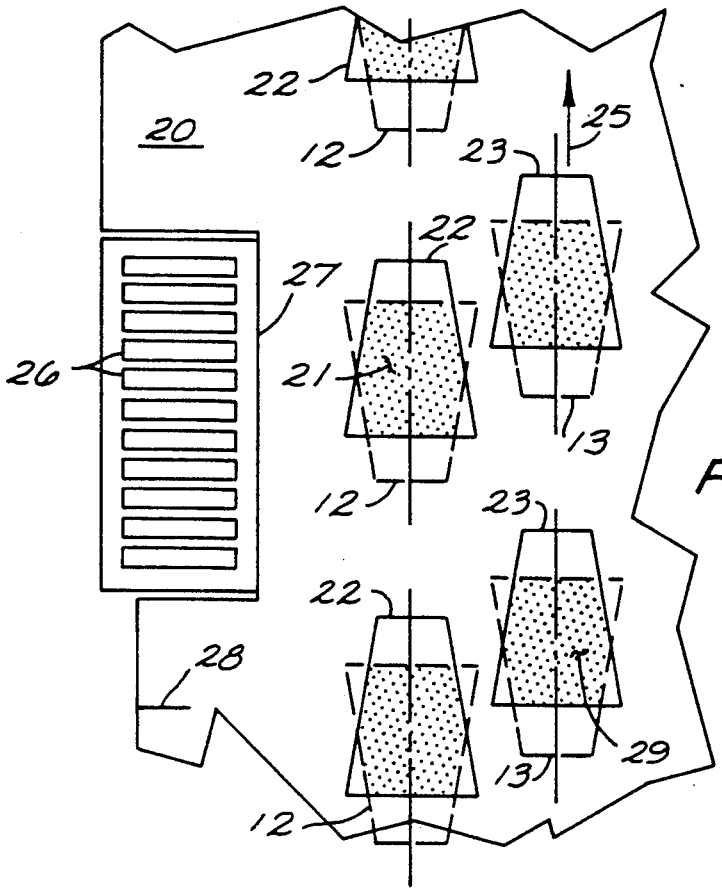
FIG. 3 is a cut-away view of a portion of the inventive sliding plate orifice damper system illustrating the formation of the composite orifice.

Referring now to FIG. 3, a cut-out section of FIG. 2 proximate the slotted rack is shown in an enlarged top plan view. First of all, slotted rack 26 is shown before it has been bent upright along bending line 27, slotted rack 26 comprising a plurality of slots cut into the sheet metal of top sliding plate 20, the slots adapted to be engaged by the teeth of toothed gear 16 rotatably attached to fixed bottom plate 10.

More importantly, shown in FIG. 3 are trapezoidal apertures 22 and 23 of top sliding plate 20 overlapping trapezoidal apertures 12 and 13 respectively of fixed bottom plate 10. The center line of the trapezoidal aperture 22 of top plate 20 is longitudinally aligned with the center line of aperture 12 of the bottom plate 10 so that as top plate 20 moves in either direction shown by arrow 25, the composite orifice 21 formed central to both trapezoidal apertures 12 and 22 (shown in dots) may be varied from the position illustrated to a position of no resultant composite orifice through continued upward movement of top plate 20. Top plate 20 is so indexed by relative placement of guide post 14 and guide slot 24 in the preferred embodiment that the starting point of top plate 20 (0% travel but maximum composite orifice) is when the major base of trapezoidal aperture 22 coincides with the minor base of trapezoidal aperture 12. From that starting position, top plate 20 moves in direction of arrow 25 until the major or minor bases respectively of both trapezoidal apertures coincide at which time there will be no flow of fluid since the orifice has been closed.

The resultant area of the composite orifice formed by the overlapping trapezoidal apertures varies non-linearly with respect to linear movement of sliding plate 20. The observed result is that the fluid flow through the composition orifice is rendered a linear relationship with sliding plate displacement. The law of fluid flow through an orifice relates the square of the area ratios of two similar orifices, thus, the non-linear relationship of the composite orifice area substantially satisfies the laws of fluid dynamics to render a linear relationship between relative positions of the plates and the fluid flow.

Figure 4:
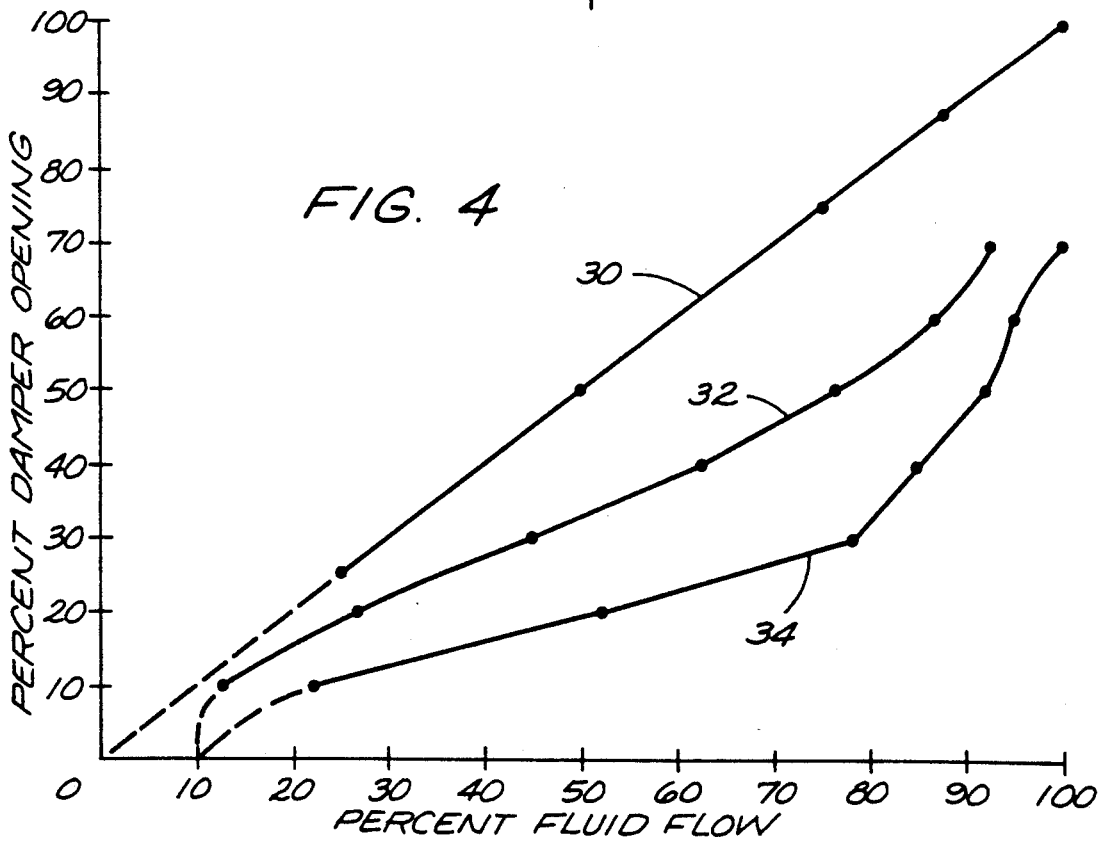
FIG. 4 is a graph showing damper opening versus fluid flow for the subject sliding plate damper system, typical opposed blade damper system, and parallel blade type damper system.

This relationship of resultant damper opening (as a movement of the top sliding plate) from zero to full wide open versus the percent of fluid flow (measured as a percent from zero fluid flow to 100%) under conditions of constant pressure is illustrated in the graph of FIG. 4.

More particularly, FIG. 4 details graphs of the subject inventive sliding plate damper system and two other damper systems. Curve 30 shows the calculated straight line relationship between the damper opening (as measured from near zero to 100% travel of the top plate) versus fluid flow (percent from no flow (0) to full flow) of the invention. Curve 32 is a measured plot of the characteristics of an opposed blade type damper system under the same parameters, and curve 34, a measured plot of a parallel blade type damper system. The dotted continuations of the plots in the lower portion of the graph were extrapolated.

Figure 5:
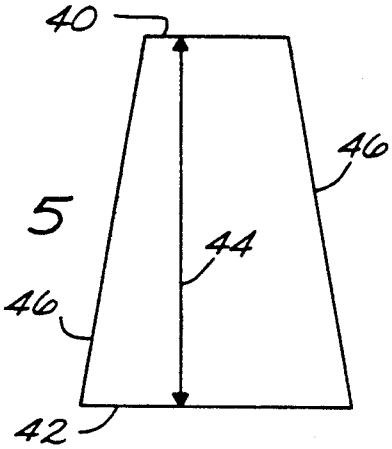
FIG. 5 is a top plan view of the ideal shaped trapezoidal aperture.

FIG. 5 is a drawing of a trapezoidal aperture wherein for best results, it has been determined the trapezoid be an isosceles trapezoid, i.e., opposite angles at each of the major and minor bases are equal. Dimensionwise, the relationship between major base 42 and minor base 40 is 2:1, and height 44 is 2.7778 times minor base 40, for the illustrated embodiment, however, in other applications, somewhat different dimensional relationships may be used.

Figure 6:
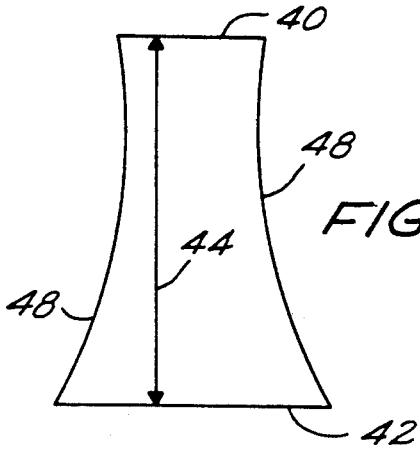
FIG. 6 is a top plan view of the idealized shaped mathematically calculated trapezoidal aperture.

It has been determined mathematically that the idealized shape that may be utilized in the invention, although it may not be the easiest to fabricate, is the modified isosceles trapezoid shown in FIG. 6. Here, the same ratio of length of minor base 40 to major base 42 is maintained, as well as the height 44 ratio to the minor base shown in FIG. 5, but the vertical inclined sides 48 of the trapezoid are curves. The isosceles trapezoid aperture with straight inclined sides was utilized in the invention, however, because the cost of fabricating the straight line trapezoid was substantially less than curved inclined sides. The cost of punching dies having curved sides for the isosceles trapezoid was prohibitive for job shop manufacturing, but would be cost justified for mass production.

Figure 7:
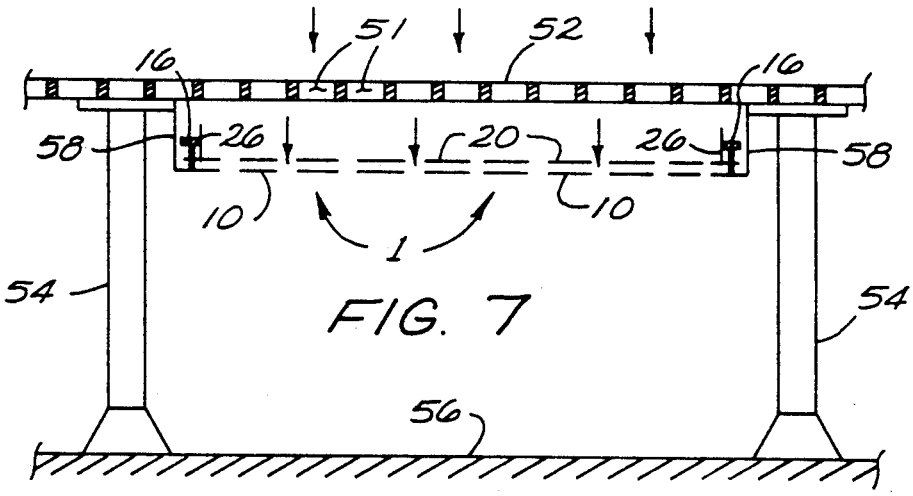
FIG. 7 is a cross sectional view of a portion of the floor system of a clean room showing the invention in place.

FIG. 7 is a cross sectional view taken through a portion of the floor section of a clean room showing the invention in place in an under-the-floor configuration. More particularly, shown in FIG. 7 is firstly the floor grate 52 with its openings 51 through which room air passes. Standing equipment in the clean room, as well as personnel, respectively rest and walk upon floor grate 52. Supporting floor grate above floor 56 are two of a plurality of adjustable jacks 54 supporting the floor in a checkerboard fashion. Situated between four jacks (two shown) is the cell containing the inventive sliding plate orifice damper 1 comprising fixed bottom plate 10 and slideable top plate 22. Shown as voids in top and bottom plates 20 and 10 respectively, are the apertures through which air flows in the direction shown by the arrows. To bottom plate 10 have been attached four side walls 58, two of which are shown, side walls 58 together with bottom plate 10 forming a plenum immediately underneath floor grate 52. As mentioned earlier, top plate 20 must be more than ¾" below the bottom of floor grate 52 in order to assure laminar air flow through the apertures. It is noted in FIG. 7 that top plate 20 is spaced apart from fixed bottom plate 10. Such was done for ease of viewing, however, in the preferred embodiment, top plate 20 rests upon bottom plate 10 so that there is very little, if any at all, space between the plates. Lastly, the sliding adjustment mechanism, comprising principally toothed gears 16, is shown engaging slotted rack 26, slotted rack 26 being a part of top sliding plate 20.

Figure 8:
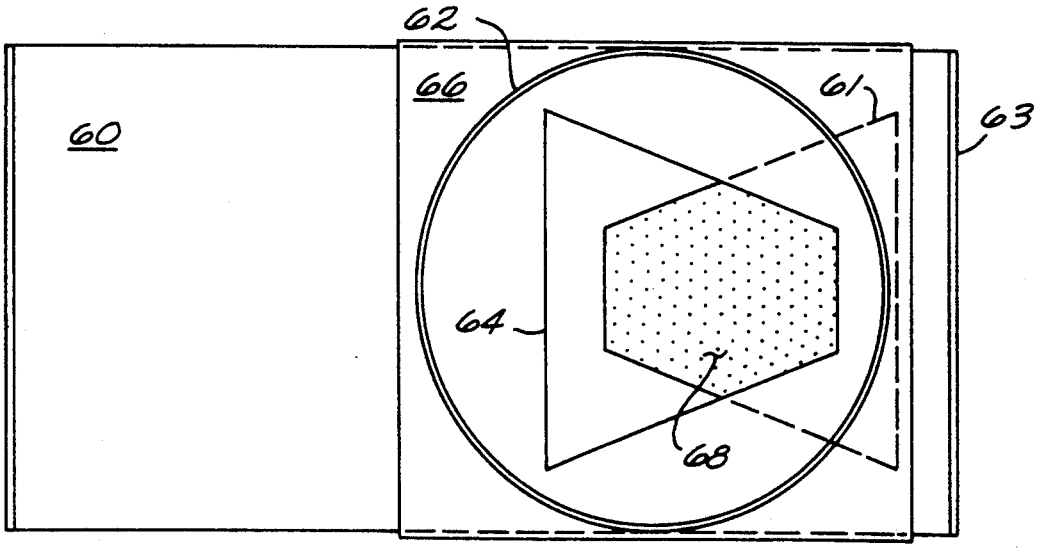
FIG. 8 is a front view of a sliding plate damper system with one orifice.

FIG. 8 shows the use of the invention in a sliding single blade damper embodiment wherein slide gate 60 is slideable across fluid duct 62. As part of the single blade damper system shown in FIG. 8 is trapezoidal aperture 64 set in fixed plate 66. Situated in sliding plate 60 is aperture 61. As can be seen, the composite orifice 68 (area shown dotted) is controlled by moving slide plate 60 left or right. To facilitate movement of sliding plate 60, end 63 of the plate has been folded for grasping.

Figure 9:
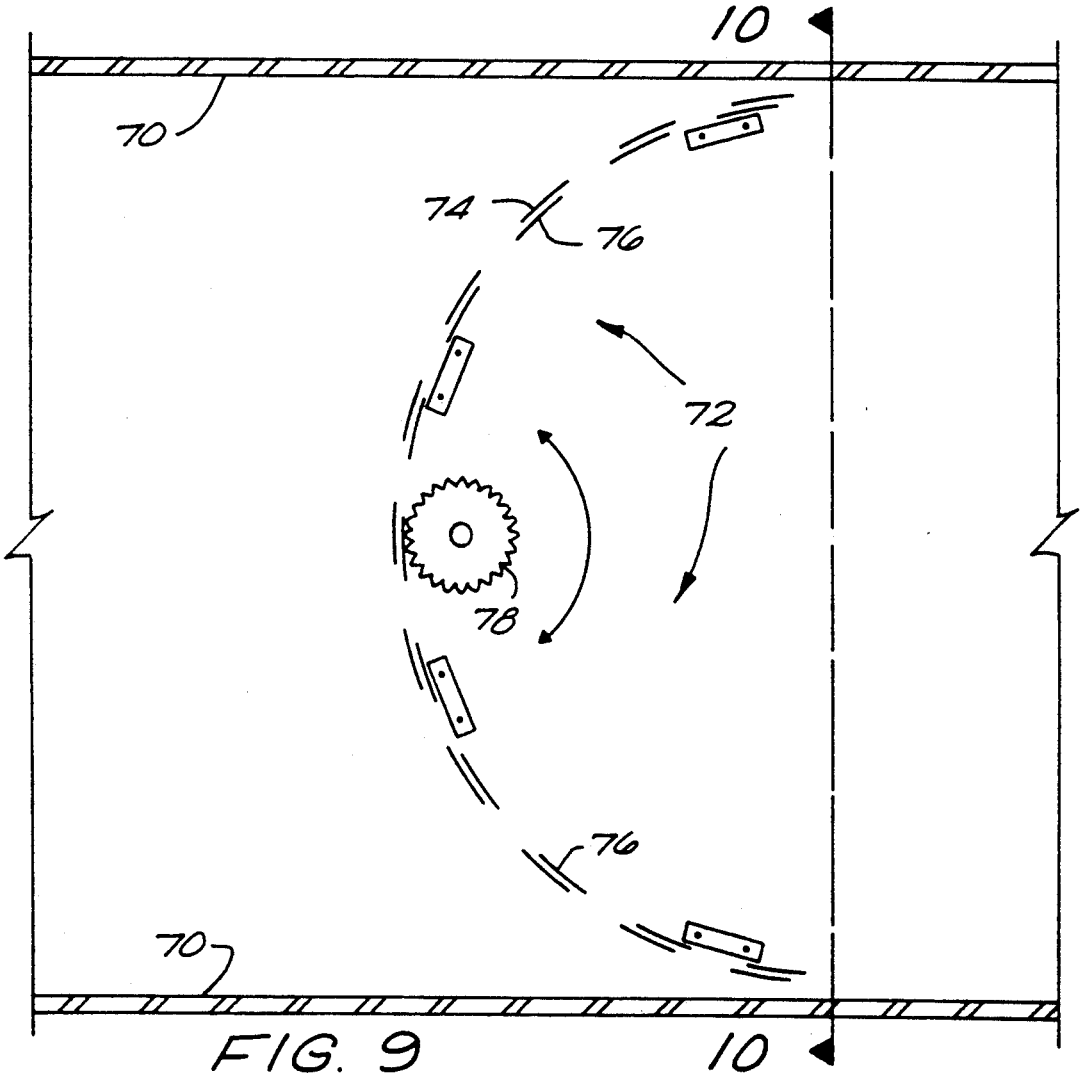
FIG. 9 is a cross sectional view of a semi-cylindrical embodiment of the invention.
Figure 10:
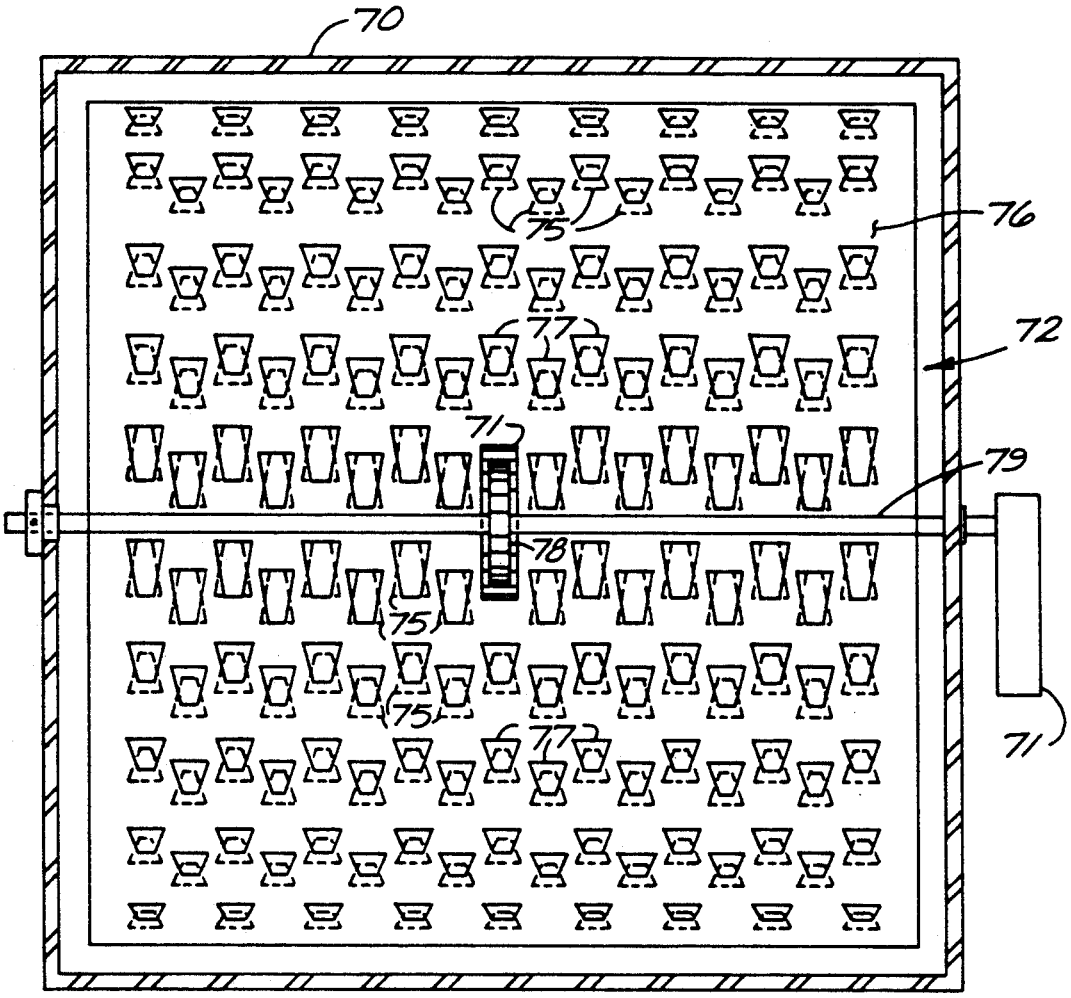
FIG. 10 is a front sectional view of the semi-cylindrical embodiment of the invention.

Referring now to FIGS. 9 and 10, the subject invention is shown utilized in a square fluid duct where control of the fluid flow is desired. More particularly, FIG. 9 is a cross sectional view taken through a portion in the longitudinal direction of square duct 70 where the invention is fashioned as a semi-cylindrical sliding plate damper. Here the sliding plate orifice system damper system 72 is so situated that its fixed plate 74 is secured at the top and bottom of square duct 70. Sliding plate 76 is disposed adjacent to fixed plate 74 along its concave surface in a touching/sliding relationship whose movement is controlled by toothed gear 78 which engages slotted rack 73 attached to sliding plate 76. Thus the composite orifice formed by the overlapping apertures of the fixed and sliding plate 74 and 76 respectively may be varied by the rotation of toothed gear 78 engaging the slotted rack.

FIG. 10 is a sectional view taken along section line 10—10 of FIG. 9 and illustrates the view seen inside duct 70 by the fluid moving interiorly. Clearly seen in solid lines are the trapezoidal shaped apertures 77 of sliding plate 76 and in dotted form trapezoidal shaped aperture 75 of fixed plate 74. Central to the sliding plate orifice damper system 72 is toothed gear 78 which acts upon attached slotted rack 71 to control the relative position of sliding plate 76 on fixed plate 74 immediately behind. For control of toothed gear 78, motor 71 acts through shaft 79, shaft 79 also the central shaft of toothed gear 78. At opposite ends of shaft 79 are bearings which rotatably secure the sliding plate 76 of damper system 72. Damper system 72 is shown with spaces separating it on the sides from duct 70, however, in the preferred embodiment, fixed plate 74 engages the sides of the duct. Of course, packing may be inserted in any undesired unregulated space found.

Figure 11:
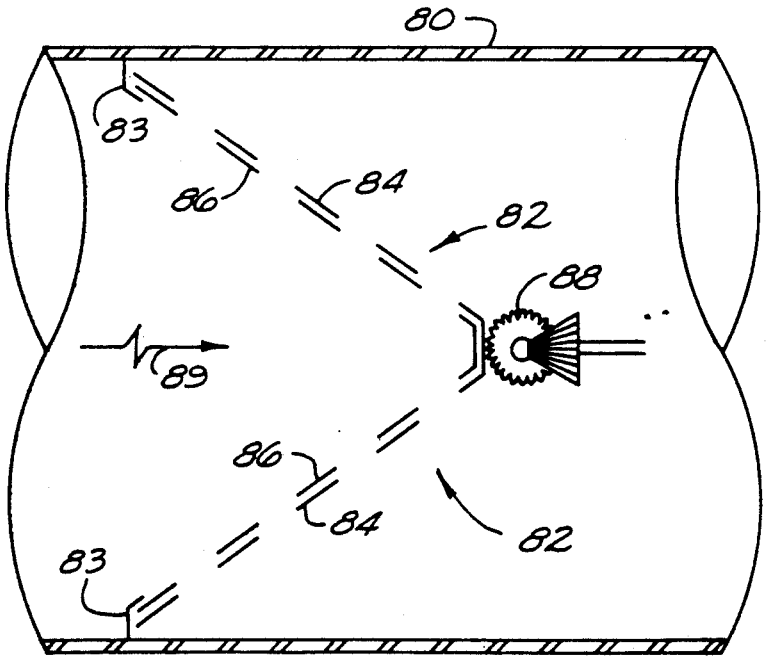
FIG. 11 is a cross sectional view of a coned shaped embodiment of the invention.

Referring now to FIG. 11, the subject invention is shown in form of a cone wherein in round duct 80, the inventive sliding plate orifice damper system 82 comprises a cone shaped fixed plate 84 with a plurality of trapezoidal shaped apertures therein and rotatable cone shaped plate 86, also with a plurality of apertures therein, rotatable plate 86 operably attached to toothed gear 88.

Here again, by forming a composite orifice between the apertures of the rotatable cone 86 and fixed cone 84, fluid flow in the direction of arrow 89 may be linearly controlled. Toothed gear 88 shown includes a right angle gear mechanism with a shaft extension through fixed conical plate 84. Flange 83 is secured to the interior walls of round duct 80 to shield fluid through the damper system 82.

While a preferred embodiment of the device has been shown and described, it will be understood that there is no intent to limit the invention by such disclosure, but rather it is intended to cover all modifications and alternate constructions falling within the spirit and scope of the invention as defined in the appended claims.

We claim:

1. An improvement in sliding plate orifice dampers utilized in fluid handling systems, the sliding plate orifice dampers of the type having a fixed plate with an aperture therethrough and a sliding plate also having an aperture therethrough, the improvement comprising:

a fixed plate having a trapezoidal shaped aperture therethrough; and a sliding plate also having a trapezoidal shaped aperture therethrough, said sliding plate moveable linearly relative to said fixed plate, said sliding plate juxtaposed said fixed plate such that said aperture of said sliding plate is in close proximity to and overlaps said aperture of said fixed plate to form a resultant composite orifice having six sides to pass fluid through both said fixed plate and said sliding plate, said sliding plate linear displacement having a straight line relationship characteristic to the volume of fluid flow through said orifice, said sliding plate slideably adjusted to selective a known volume of fluid flow.

2. The improvement in sliding plate orifice dampers as defined in claim 1 wherein said trapezoidal shaped aperture in said fixed plate has an orientation relative to said fixed plate and said trapezoidal shaped aperture in said sliding plate also has an orientation relative to said sliding plate, said sliding plate slideably juxtaposed said fixed plate such that said orientation of said trapezoidal shaped aperture of said fixed plate is opposite to said orientation of said trapezoidal shaped aperture of said sliding plate.

3. The improvement in sliding plate orifice dampers as defined in claim 2 wherein each said trapezoidal shaped aperture of said fixed plate and of said sliding plate has a major base and a minor base, and a height between said major base and minor base, and each said trapezoidal shaped aperture of said fixed plate and of said sliding plate defines a center line bisecting said major base and said minor base.

4. The improvement in sliding plate orifice dampers as defined in claim 3 wherein said trapezoidal shaped aperture of said fixed plate defines an isosceles trapezoid and said trapezoidal shaped aperture of said sliding plate also defines an isosceles trapezoid, and said trapezoidal shaped aperture of said fixed plate is the same size as said trapezoidal shaped aperture of said sliding plate.

5. The improvement in sliding plate orifice dampers as defined in claim 4 wherein said center line of said fixed plate trapezoidal shaped aperture coincides with said center line of said sliding plate trapezoidal shaped aperture to form said resultant composite orifice.

6. The improvement in sliding plate orifice dampers as defined in claim 5 further including means to align said sliding plate to said fixed plate, said means to align maintaining said center line of said sliding plate trapezoidal aperture coincident with said center line of said fixed plate trapezoidal aperture as said sliding plate is moved relative to said fixed plate, and means to controllably adjust said position of said sliding plate relative to said fixed plate.

7. The improvement in sliding plate orifice dampers as defined in claim 6 wherein said fixed plate is planar, and said sliding plate is also planar.

8. The improvement in sliding plate orifice dampers as defined in claim 6 wherein said fixed plate is curved and said sliding plate is also curved.

9. The improvement in sliding plate orifice dampers as defined in claim 6 wherein said fixed plate is conical and said sliding plate is also conical.

10. The improvement in sliding plate orifice dampers as defined in claim 6 wherein each said trapezoidal shaped aperture in said fixed plate and in said sliding plate has two oppositely situated non-parallel, non-intersecting straight sides connecting each said respective major base to said minor base.

11. The improvement in sliding plate orifice dampers as defined in claim 6 wherein each said trapezoidal shaped aperture in said fixed plate and in said sliding plate has two oppositely situated non-intersecting curved lines connecting each said respective major base to said minor base.

12. An improvement in sliding plate orifice dampers utilized in fluid handling systems, the sliding plate orifice dampers of the type having a fixed plate with a plurality of apertures therethrough and a sliding plate also having a plurality of apertures therethrough, the improvement comprising:

a fixed plate having a plurality of spaced apart trapezoidal shaped apertures therethrough;

a sliding plate also having a plurality of spaced apart trapezoidal shaped apertures therethrough, said sliding plate moveable linearly relative to said fixed plate, said sliding plate juxtaposed said fixed plate such that one each of said plurality of apertures of said sliding plate overlaps one each of said plurality of apertures of said fixed plate to form a plurality of spaced apart resultant composite orifices each having six sides to pass fluid through both said fixed plate and said sliding plate, said sliding plate linear displacement having a straight line relationship characteristic to the volume of fluid flow through said plurality of orifices, said sliding plate slideably adjusted to select a known volume of fluid flow.

13. The improvement in sliding plate orifice dampers as defined in claim 12 wherein each of said plurality of trapezoidal shaped apertures in said fixed plate have an orientation relative to said fixed plate and each of said plurality of trapezoidal shaped apertures in said sliding plate also have an orientation relative to said sliding plate, said sliding plate slideably juxtaposed said fixed plate such that said orientation of each of said plurality of trapezoidal shaped apertures of said fixed plate is opposite to said orientation of each of said plurality of trapezoidal shaped apertures of said sliding plate.

14. The improvement in sliding plate orifice dampers as defined in claim 13 wherein each of the said plurality of trapezoidal shaped apertures of said fixed plate and of said sliding plate has a major base and a minor base, and a height between each said major base and said minor base, and each of said plurality of said trapezoidal shaped apertures of said fixed plate and of said sliding plate defines a center line bisecting said major base and said minor base.

15. The improvement in sliding plate orifice dampers as defined in claim 14 wherein each of said plurality of trapezoidal shaped apertures of said fixed plate defines an isosceles trapezoid and each of said plurality of trapezoidal shaped apertures of said sliding plate also defined an isosceles trapezoid, and each of said plurality of said trapezoidal shaped apertures of said fixed plate is the same size as each of said plurality of said trapezoidal shaped apertures of said sliding plate.

16. The improvement in sliding plate orifice dampers as defined in claim 15 wherein said center line of each of said plurality of trapezoidal shaped apertures of said fixed plate coincides with said center line of a respective trapezoidal shaped aperture of said sliding plate to form said resultant composite orifices.

17. The improvement in sliding plate orifice dampers as defined in claim 16 further including means to align said sliding plate to said fixed plate, said means to align maintaining said center line of each of said plurality of trapezoidal shaped apertures of said sliding plate trapezoidal aperture coincident with said center line of respective trapezoidal apertures of said fixed plate as said sliding plate is moved relative to said fixed plate, and means to controllably adjust said position of said sliding plate relative to said fixed plate.

18. The improvement in sliding plate orifice dampers as defined in claim 16 wherein said plurality of trapezoidal shaped apertures of said fixed plate are arranged in rows and in columns, and said plurality of trapezoidal shaped apertures of said sliding plate are also arranged in rows and columns, said arrangement of trapezoidal shaped apertures of said sliding plate complimentary to said arrangement of plurality of trapezoidal shaped apertures of said fixed plate such that each of the plurality of trapezoidal shaped apertures of said fixed plate has a corresponding overlapping trapezoidal shaped aperture of said sliding plate.

19. The improvement in sliding plate orifice dampers as defined in claim 18 wherein each said arrangement of trapezoidal shaped apertures of said sliding plate and of said fixed plate define a first set of rows and columns and a second set of rows and columns, said second set of rows and columns selectively interlaced with said first set of rows and columns.

20. The improvement in sliding plate orifice dampers as defined in claim 19 wherein said fixed plate is planar and said sliding plate is also planar.

21. The improvement in sliding plate orifice dampers as defined in claim 19 wherein said fixed plate is curved and said sliding plate is also curved.

22. The improvement in sliding plate orifice dampers as defined in claim 19 wherein said fixed plate is conical and said sliding plate is also conical.

* * * * *